US005128722A

United States Patent [19]

Natsuhara et al.

[11] Patent Number: 5,128,722

[45] Date of Patent: Jul. 7, 1992

[54] DEVELOPING DEVICE EXCELLENT IN TONER TRANSPORTABILITY

[75] Inventors: Toshiya Natsuhara; Hiroshi Mizuno; Yuji Enoguchi; Akihito Ikegawa, all of Osaka, Japan

[73] Assignee: Minolta Camera Kabushiki Kaisha, Osaka, Japan

[21] Appl. No.: 634,819

[22] Filed: Jan. 2, 1991

Related U.S. Application Data

[63] Continuation of Ser. No. 334,434, Apr. 7, 1989, abandoned.

[30] Foreign Application Priority Data

Apr. 8, 1988 [JP] Japan ..... 63-87537

[51] Int. Cl.[5] ..... G03G 15/06

[52] U.S. Cl. ..... 355/259; 118/653; 118/661; 430/102

[58] Field of Search ..... 355/251, 252, 259; 118/661, 647, 651, 653, 659; 430/101, 102

[56] References Cited

U.S. PATENT DOCUMENTS

| | | | |
|---|---|---|---|
| 3,830,199 | 8/1974 | Saito et al. | 118/661 |
| 4,011,834 | 3/1977 | Stephan | 118/653 |
| 4,092,165 | 5/1978 | Andrus et al. | 430/102 X |
| 4,100,884 | 7/1978 | Mochizuki et al. | 118/653 |
| 4,331,754 | 5/1982 | Stephan | 355/259 X |
| 4,377,332 | 3/1983 | Tamura . | |
| 4,380,966 | 4/1983 | Isaka et al. | 118/651 |
| 4,485,760 | 12/1984 | Tanaka et al. | 355/251 X |
| 4,558,943 | 12/1985 | Patz | 355/259 |
| 4,564,285 | 1/1986 | Yasuda et al. | 355/259 X |
| 4,566,781 | 1/1986 | Kuehnle | 118/661 X |
| 4,616,918 | 10/1986 | Kohyama et al. | 355/259 |
| 4,780,741 | 10/1988 | Wada et al. | 118/653 X |
| 4,791,882 | 12/1988 | Enoguchi et al. | 355/259 X |
| 4,883,017 | 11/1989 | Yuji et al. | 355/259 X |
| 4,978,597 | 12/1990 | Nakahara et al. | 430/122 |
| 4,982,689 | 1/1991 | Honda et al. | 355/259 X |
| 4,987,454 | 1/1991 | Natsuhara et al. | 355/259 |

FOREIGN PATENT DOCUMENTS

| | | | |
|---|---|---|---|
| 56-113172 | 9/1981 | Japan | 355/259 |
| 57-116372 | 7/1982 | Japan | 355/259 |
| 61-180249 | 8/1986 | Japan | 355/259 |

*Primary Examiner*—A. T. Grimley
*Assistant Examiner*—Matthew S. Smith
*Attorney, Agent, or Firm*—Burns, Doane, Swecker & Mathis

[57] ABSTRACT

The present invention provides a developing device disposed adjacently to a rotatably arranged electrostatic latent image support member, including;

a rotatably arranged toner transport member contacting the electrostatic latent image support member and a member contacting the toner transport member for forming a toner layer on external surface of the toner transport member, the toner transport member including irregularities of 20-200 μm in mean mountain distance on its surface.

21 Claims, 4 Drawing Sheets

DEVELOPING DEVICE EXCELLENT IN TONER TRANSPORTABILITY

This application is a continuation of application Ser. No. 07/334,434, filed Apr. 7, 1989, now abandoned.

BACKGROUND OF THE INVENTION

The present invention relates to a developing device with respect to electrostatic latent images, in which non-magnetic toners of mono-component are provided on the electrostatic latent images to be made visible. The developing device of the invention may be applied to an electrographic copying machine, or a recording machine for electrostatic latent images.

There is known a mono-component developing method in which a thin layer of charged toners uniformly formed on a toner transport member is brought into contact with a photosensitive member or a photoreceptor to develop electrostatic latent images (e.g. Japanese Patent Laid-Open No. 143831/1977).

There are many systems for a mono-component developing method. In principle, a cylindrical toner-transport member is set between a photoreceptor drum on which electrostatic latent images are formed and a mono-component toner container. A toner-levelling member, which plays a role in charging toners, is pressed against the toner transport member. Toners are charged positively or negatively to an adequate level while passing through between the toner transport member and the toner levelling member. At the same time, a thin layer of charged toners is formed on the toner transport member and the toners are transported to the photoreceptor and attracted electrostatically to electrostatic latent images on the photoreceptor to be made visible.

It is important for a mono-component developing system in a developing method to provide the surface of a toner transport member with a thin layer of charged toners. Particularly, it is necessary to form an homogeneous layer on a toner transport member with respect to both charge amount and layer thickness. The uniformity of toners on the toner transport member is an important element which influences image qualities directly.

SUMMARY OF THE INVENTION

The object of the invention is to provide an improved developing device of a contact type for single-component toner wherein a toner transport member has irregularities on its surface to improve a toner transporting ability and a toner charging ability, resulting in the image formation excellent in image qualities without fogs and the like.

The present invention is to provide a developing device disposed adjacently to a rotatably arranged electrostatic latent image support member which comprises:

a rotatably arranged toner transport member contacting the electrostatic latent image support member and having irregularities of 20–200 μm in mean mountain distance on its surface; and a means for forming a toner layer on the external surface of the toner transport member.

BRIEF DESCRIPTION OF THE INVENTION

DETAILED DESCRIPTION OF THE INVENTION

Figure 1:
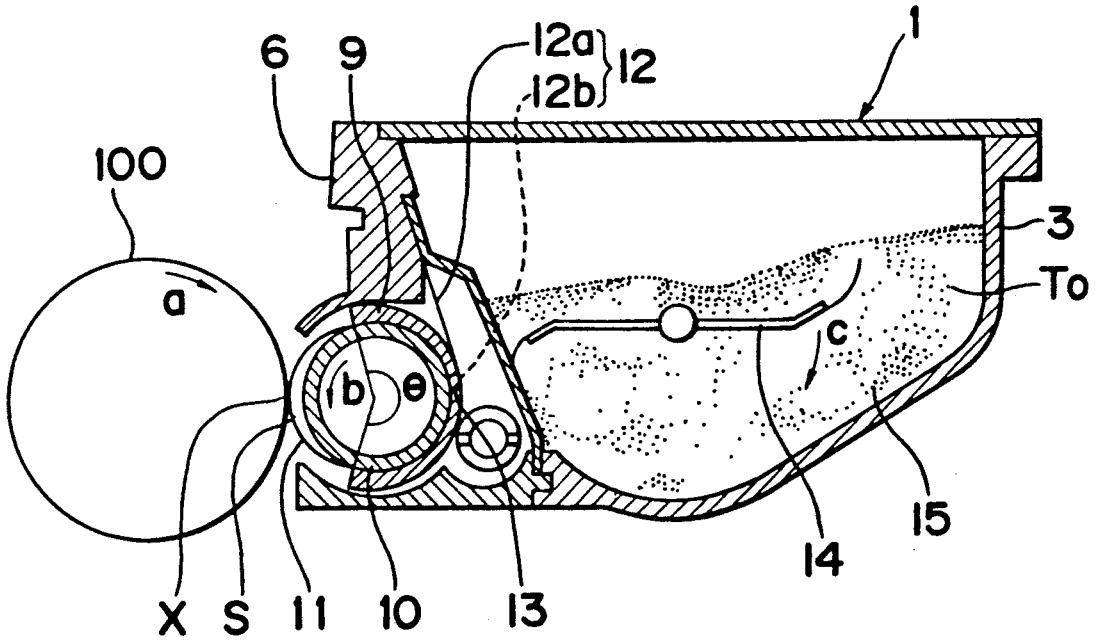
FIG. 1 and FIG. 2 show schematic sectional views of developing devices of the present invention.

The present invention provides an electrostatic latent image developing device of a contact type for a mono-component toner wherein toners can be charged uniformly, a thin layer of toners can be formed uniformly on a toner transport member and the toners can be transported effectively to a developing region under the uniform conditions in both the charge amount and the layer thickness. The developing device can achieve the formation of copied images excellent in image qualities without fogs on a sheet and the like, the density of images and the like.

The present invention has accomplished the above objects by the formation of irregularities on the surface of a toner transport member used in an electrostatic latent image developing device of a contact type for a single component toner.

This invention is exemplified by examples referring to the drawings.

FIG. 1 is a cross-sectional view of a developing device (1) of the present invention. The developing device (1) adjoins a photoreceptor drum (100) driven rotatably in a direction as shown by an arrow (a).

The developing device (1) is generally provided with a rotatably arranged roller (10) and a filmy member (11) which is loosely mounted around the roller (10), a couple of guide pads (9) for the firm contact of the filmy member (11) with the roller (10), a toner layer thickness levelling member (12) pressed against the external surface of the filmy member (11) and a casing (3) accommodating these members (9), (10), (11) and (12) and storing therein a certain amount of Toner (To).

The rotatably arranged roller (10) is composed of an electrically conductive material such as aluminium or the like and a conductive elastic material such as rubber, plastic or the like formed on the electrically conductive material. A developing bias voltage Vb is applied to the roller.

The roller (10) may be produced with an electrically conductive substrate such as aluminium with the surface roughned by blast treatment.

The filmy member (11) is formed cylindrically and has a peripheral length slightly longer than that of the developing roller (10) so as to be loosely mounted. The surface of the filmy member is unevenly formed in the present invention.

The surface of the filmy member (11) is provided with irregularities in the present invention. The irregularities are specified by mean mountain distance (Sm).

Figure 4:
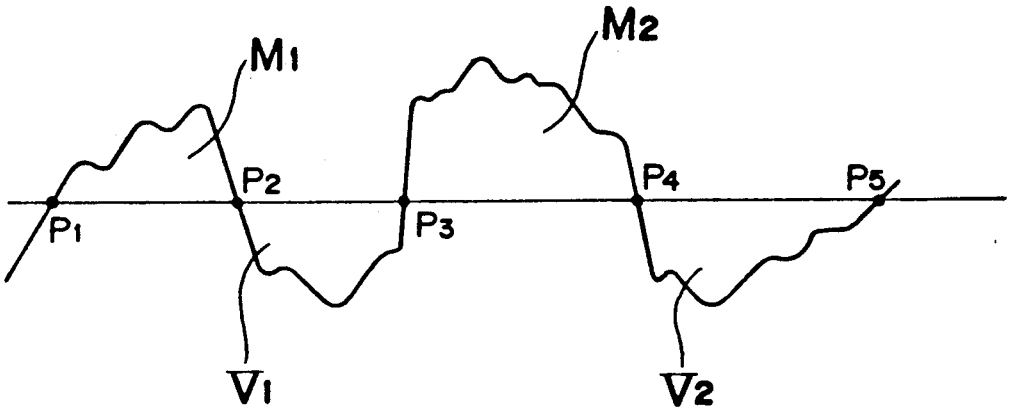
FIG. 4 is to explain mean mountain distance.

The mean mountain distance (Sm) may be specified by, for example, SURFCOM 550A (made by Tokyo Seimitsu K.K.) for the measurement of surface irregularities or surface outline shape. The mean mountain distance (Sm) is explained as follows in FIG. 4. A irregularly curved line in FIG. 4 shows a cross sectional view of the surface of a filmy member. A straight line is drawn across the irregularly curved line at the intersection points ($P_1$, $P_2$. . . $P_{2n+1}$) so that the total area of the mountain portions $M_1$, $M_2-M_n$ which is that area above the straight line and below the curved line may be equal to the total area of the valley portions $V_1$, $V_2-V_n$ which is that area below the straight line and above the curved line. The length of segment $P_1P_2$ plus $P_2P_3$ is referred to as a mountain distance ($S_1$). $S_2$ is the length of segment $P_3P_4$ plus $P_4P_5$. $S_3 \ldots S_n$ are obtained respectively in a manner similar to $S_1$ and $S_2$.

The mean mountain distance (Sm) is expressed by the equation using $S_1$, $S_2$.....Sn;

$$Sm = (S_1 + S_2 + \ldots\ldots + Sn)/n$$

In this embodiment, n is limited to the extent that $(S_1 + S_2 + \ldots\ldots + Sn)$ does not exceed 2.5 mm.

The mean mountain distance (Sm) is 20–200 μm, preferably 40–160 μm. If Sm is more than 200 μm, a toner amount (M) covering a filmy member (11) decreases while a charge amount Q increases. The lack of toner amount covering a filmy member results in the deterioration of image quality such as image density and the like although fogs on a sheet and toner flying around characters hardly occur. If Sm is less than 20 μm, a filmy member may transport sufficient amount of toners but a charge amount of toners decreases, resulting in the deterioration of image quality such as fogs on a sheet, toner flying around characters, sleeve memories and the like. It may be proposed that a toner levelling member is pressed strongly against a filmy member in order to charge toners to a practical level, but it is not preferable because increased mechanical load (torque) is required.

Irregularities formed on the surface of a filmy member may be also expressed by ten points mean roughness (Rz) (JIS B 0601-1982).

Figure 5:
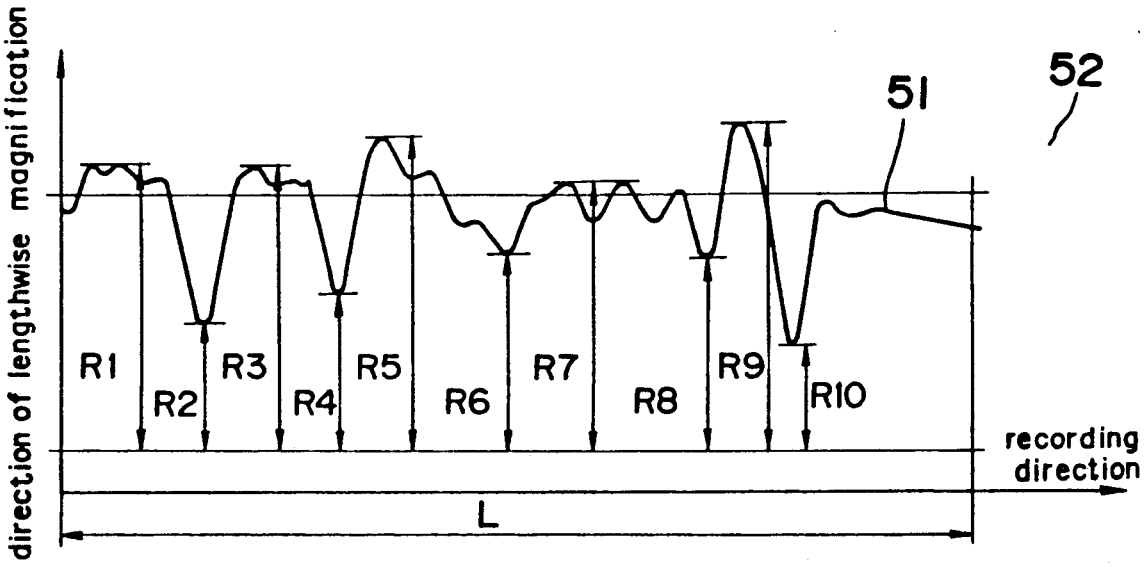
FIG. 5 is to explain ten-points mean roughness.

The ten points mean-roughness is explained in FIG. 5. Irregularly curved line (51) in FIG. 5 shows a cross sectional view of the surface of a filmy member within the range of basic length (L). The ten points mean-roughness (Rz) is the difference (μm) between the mean height of the higher five mountain tops and that of the lower five valley bottoms. Each height is measured lengthwise from the straight line which is parallel to the mean line (52) and does not cross the curved line (51).

Rz is represented by the formula below;

$$Rz = \frac{(R_1 + R_3 + R_5 + R_7 + R_9) - (R_2 + R_4 + R_6 + R_8 + R_{10})}{5}$$

wherein $R_1$, $R_3$, $R_5$, $R_7$, $R_9$ are the heights of the five higher mountain tops within the range of basic length (L): $R_2$, $R_4$, $R_6$, $R_8$, $R_{10}$ are the heights of the five lower valley bottoms within the range of basic length (L).

The ten points mean-roughness (Rz) may be measured, for example, by SURFCOM 550A.

The ten points mean-roughness (Rz) is 5 μm or less, preferably 3 μm or less under practical conditions in a developing device (about 5 g/mm in pressure of a toner levelling member to a photoreceptor). If the surface of the filmy member is made much rough to the degree of more than 5 μm in ten points mean-roughness, the transportability of toners becomes good, but toners can not be charged sufficiently to result in the deterioration of image quality such as fogs on a sheet, toner flying around characters, sleeve memories and the like.

Irregularities on the surface of a filmy member may be, for example, prepared by forming a deposition layer containing therein fine particles on an electroformed member such as Ni and the like or formed by blast treatment.

In case where irregularities are formed by the former method, the limitation is not particularly given to the shape and size of said particles, or the size distribution but preferable fine particles have a fixed form (such as spherical form) and a sharp distribution of particle sizes from the viewpoint of a uniform toner layer.

In more detail, in order to form irregularities on the surface of a filmy member, a metal layer is deposited on a outermost surface of Ni-electroformed layer in a deposition solution containing alumina particles at the content of, for example, 10–60% by weight.

And then, the portion of guide pads (9) in contact with the filmy member (11) is circular in accordance with the surface shape of the roller (10). Accordingly, the filmy member (11) is brought into close contact with the external surface of the roller (10), and a space (S) is formed between the filmy member (11) and the roller (10) because an excessive peripheral portion of the filmy member (11) having the longer periphery than that of the roller (10) is collected at the open side of the guide pads. Consequently, the protruding portion of the filmy member (11) covering the space S is brought into contact, at its external surface, with the peripheral surface of the photoreceptor drum (100).

The portion of guide pads (9) in contact with the filmy member (11) may be not continuous so far as it is substantially circular and the filmy member is brought into close contact with the roller (10).

The guide pads (9) are preferably made of a synthesized resin such as polyethylene, nylon, polyacetal, polypropylene or the like.

It is to be noted that the guide pads (9), the roller (10) and the filmy member (11) are selected to satisfy a relation of $\mu_1 > \mu_2$, where a dynamic coefficient of friction between the external surface of the roller (10) and the internal surface of the filmy member (11) is $\mu_1$ and that between the external surface of the filmy member (11) and the guide pad (9) is $\mu_2$. Accordingly, when the developing roller (10) is caused to rotate in a direction as shown by an arrow (b), the filmy member (11) rotates together with the rotation of the roller (10).

The toner levelling member (12) is mounted on the rear side of the support member (6) provided above the roller (10) and its end contacts with the filmy member (11).

The end of the toner levelling member (12) is pressed against the filmy member (11) in the region where the guide pads (9) press the filmy member (11) against the roller (10), namely, a diagonally upper portion of the rear side of the roller (10). The press position of the toner levelling member (12) is preferably the latter (or lower) half of its region near a developing region, because the filmy member is prevented from its separation from the roller, caused by the contact of the photoreceptor (100) with the filmy member (11), and a thin layer of toner is formed steadily.

The toner levelling member may be made of any one conventionally used, for example, a metallic thin plate such as stainless steel, phosphor bronze and the like, a plastic plate such as Teflon, nylon and the like or a hybrid plate thereof, and preferably they are elastic. The toner levelling member (11) is preferably made of more negative material of frictional electrification series for a positively chargeable (+) toner, and more positive material of frictional electrification series for a negatively chargeable (−) toner. For example, a sheet or a coating of fluorine resin such as Teflon and the like is suitable for (+) toner, and a sheet or coating of polyamide such as nylon and the like is suitable for (−) toner.

The toner levelling member may have a rigid body such as a metallic bar (12b) contacting the filmy member at the end of an elastic thin plate (12a) as shown in FIG. 1.

A toner storing compartment (15) is formed at the rear portion of the casing (3) and is internally provided with an agitator (14) disposed rotatably in a direction as shown by an arrow (c). The agitation (14) functions to agitate the toner To stored in the toner storing compartment (15) in a direction as shown by the arrow (c) for prevention of blocking thereof.

Although non-magnetic toner is desirably employed as mono-component toner in the developing device of this embodiment, magnetic toner may be used therein. A filmy member made magnetic may be attracted to a roller equipped with magnet therein. Any other means may be taken instead of a guide pad in order to bring a filmy member into close contact with a roller.

Figure 2:
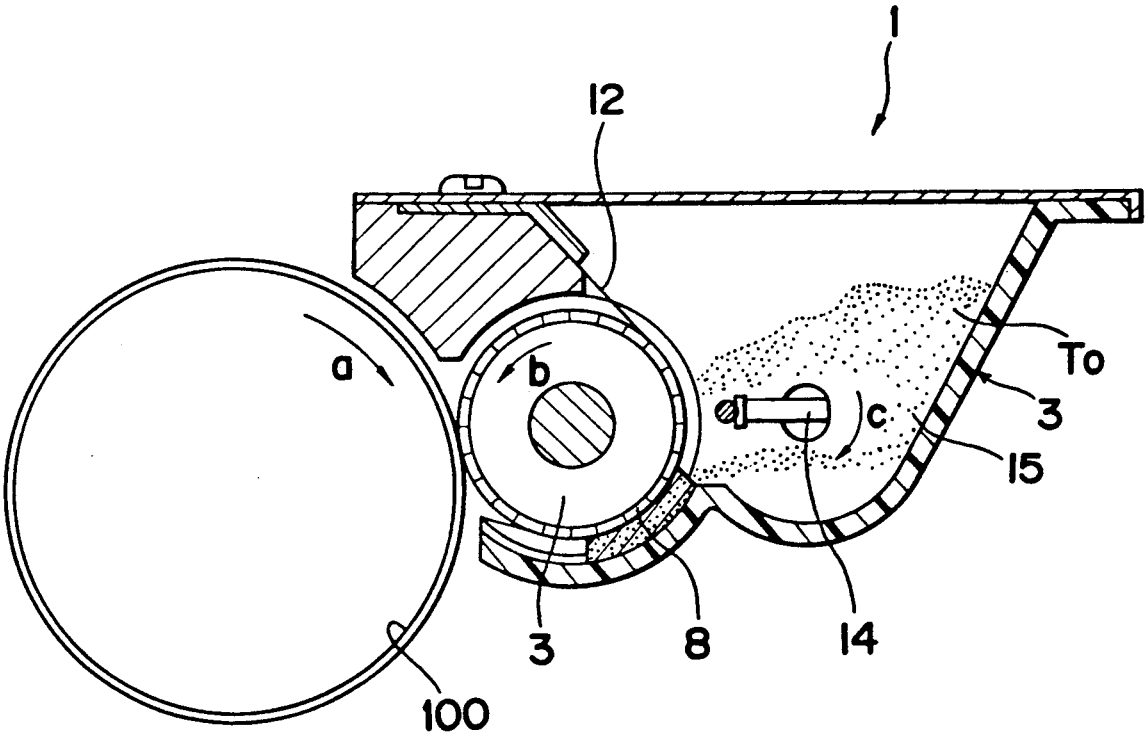

FIG. 2 shows other embodiment of the developing device, which is mainly different from that of FIG. 1 in a toner transport member. That is, a filmy member in FIG. 2 has same peripheral length as that of the roller (3). Accordingly, the filmy member (8) is formed cylindrically and mounted firmly on the roller (3). The filmy member (8) is made uneven according to the present invention as described above.

The operation of the developing device (1) having the above described constitution is illustrated in FIG. 2.

On condition that the roller (10) and the agitator (14) are caused to rotate by a driving source (not shown) respectively in directions as shown by the arrows (b) and (c), the toner To accommodates within the toner storing compartment (15) is forcibly moved in a direction shown by the arrow (c) under an effect of stirring by the agitator (14).

Meanwhile, the filmy member (11) is driven to rotate in a direction as shown by the arrow (b) under the influence of frictional force exerting between it and the roller (10), thus resulting in that the toner To in contact with the filmy member (11) is transported in a direction of rotation of the filmy member (11) by the action of electrostatic force. When the toner To is caught in a wedge-shaped taken-in portion (13) formed between the filmy member (11) and the metallic bar (12b) and reaches a pressure portion between the filmy member (11) and the toner-levelling member (12), the toner To is spread uniformly in the form of a thin layer on the surface of the filmy member (11) and charged positively or negatively through the friction therewith.

When the toner To held on the filmy member (11) under the influence of the electrostatic force, reaches a developing region X confronting the photoreceptor drum (100) in compliance with the movement of the filmy member (11) following the roller (10), the toner To is caused to adhere to an electrostatic latent image formed on the surface of the photoreceptor drum (100) to form a toner image in accordance with a voltage difference between a surface voltage of the photoreceptor drum (100) and the bias voltage applied to the roller (10).

Since the roller (10) in contact with the filmy member (11) is never brought into contact with the photoreceptor drum (100) due to the existence of the space S, the filmy member (11) softly and uniformly contacts with the photoreceptor drum (100) through its suitable nip width so that the latent image formed on the photoreceptor drum (100) may be turned to the uniform toner image. A peripheral speed of the photoreceptor drum (100) may be caused to differ from that of the filmy member (11), and the toner image once forced on the photoreceptor drum (100) can never be broken.

The toner To having passed the developing region X is successively transported, together with the filmy member (11), in the direction as shown by the arrow (b).

The toner To is provided again on the surface of the filmy member (11) by the force of rotation of the agitator (14). Consequently, the thin layer of the charged toner is uniformly formed again on the surface of the filmy member (11) at the pressure portion of the toner-levelling member (12) and, the aforementioned process is repeated thereafter.

TEST EXAMPLE 1

Nickel electroformed belt sleeve

A Nickel belt sleeve (as a thin filmy member) was prepared by electroforming method as below.

First, a Ni-deposit layer of about 30 μm in thickness was formed. Then, a complex deposit layer containing Ni-alumina fine particles was formed on the Ni-deposit layer in a solution for Ni-deposition containing alumina particles (about 8 μm in mean particle size) at the content of 15 percents by weight. Thus, Nickel electroformed belt sleeve was obtained, the surface of which was provided with irregularities of 2.34 μm in ten-points mean roughness (Rz) and 143 μm in mean mountain distance.

The resultant Nickel belt sleeve was installed in the developing device shown in FIG. 1 to evaluate layer conditions of charged toners, and image qualities were evaluated using Printer SP124 (85 mm/sec) (produced by Minolta Camera).

The toner coverage M ($mg/cm^2$) and the toner charge amount Q (μC/g) were 0.43 ($mg/cm^2$), −16.0 (μC/g) respectively and I.D., which was measured with Sakura Densitometer PDA 65, was 1.4 or more. Clear images were formed without fogs on the paper sheet and toner-flying around the images.

TEST EXAMPLE 2

A Nickel electroformed belt sleeve was prepared in a similar manner to that of Test Example 1, except that the content of alumina was 40 percents by weight.

The obtained belt sleeve had the ten-points mean roughness (Rz) of 2.60 μm, and the mean mountain distance (Sm) of 53 μm.

The belt sleeve was evaluated in a manner similar to that of Test Example 1 to obtain the toner coverage of 0.535 ($mg/cm^2$) the toner charge amount of −14.5 (μC/g) and I.D. of 1.4 or more. Clear images were formed without fogs on the paper sheet and toner-flying around the images.

TEST EXAMPLES 3–7

Nickel electroformed belt sleeves with Rz and Sm shown in Table 1 were prepared in a similar manner to that of Test Example 1, except that the content of alumina were varied.

They were evaluated in a manner similar to that of Test Example 1. The results were shown in Table 1, which contains also the results of Test Examples 1 and 2.

TABLE 1

| Test Examples | 3 | 4 | 2 | 5 | 1 | 6 | 7 |
|---|---|---|---|---|---|---|---|
| Sm(μm) | 15 | 24 | 53 | 108 | 143 | 185 | 285 |
| Rz(μm) | 2.25 | 2.51 | 2.60 | 2.47 | 2.34 | 2.38 | 2.59 |
| toner thin layer | | | | | | | |
| toner coverage amount (mg/cm²) | 0.665 | 0.610 | 0.535 | 0.465 | 0.430 | 0.405 | 0.365 |
| charge amount (−μC/g) | 12.6 | 13.3 | 14.5 | 15.5 | 16.0 | 16.4 | 17.0 |
| uniformity | good | good | good | good | good | normal | poor |
| I.D. | ≧1.4 | ≧1.4 | ≧1.4 | ≧1.4 | ≧1.4 | 1.3~1.4 | <1.3 |
| fogs on sheet (and toner flying) | poor | normal | good | good | good | good | good |

In Table 1, uniformity means surface texture (denseness) in image quality. "Good" means that the surface texture is good.

TEST EXAMPLE 8

Nylon belt sleeve

A resin (Nylon) belt sleeve (as a filmy layer) was prepared by extrusion processing method. The belt sleeve had about 350 μm in thickness and carbon fine particles were uniformly dispersed in Nylon resin at the content of 8% by weight to obtain the surface resistance of $10^5$–$10^6$(Ω·cm). Further, alumina particles were also incorporated into the sleeve at the content of 10%.

The resultant belt had the ten-points mean roughness (Rz) of 2.27 μm, and the mean mountain distance (Sm) of 58 μm.

The sleeve was evaluated in a similar manner to that of Test Example 1 to obtain the toner coverage of 0.52 (mg/cm²), the toner charge amount of −17.1 (μC/g) and I.D. of 1.4 or more. Clear images were formed without fogs on the paper sheet and toner flying around the images.

TEST EXAMPLES 9-12

Nylon resin belt sleeves with Rz and Sm shown in Table 2 were prepared in a similar manner to that of Test Example 8, except that the content of alumina were varied.

They were evaluated in a manner similar to that of Test Example 8. The results were shown in Table 2.

TABLE 2

| Test Examples | 9 | 10 | 11 | 12 |
|---|---|---|---|---|
| Sm(μm) | 58 | 92 | 135 | 41 |
| Rz(μm) | 2.27 | 2.43 | 2.35 | 2.21 |
| toner thin layer | | | | |
| toner coverage amount (mg/cm²) | 0.520 | 0.480 | 0.440 | 0.560 |
| charge amount (−μC/g) | 17.1 | 18.1 | 19.1 | 16.3 |
| uniformity | good | good | good | good |
| I.D. | ≧1.4 | ≧1.4 | ≧1.4 | ≧1.4 |
| fogs on sheet (and toner flying) | good | good | good | good |

Figure 3:
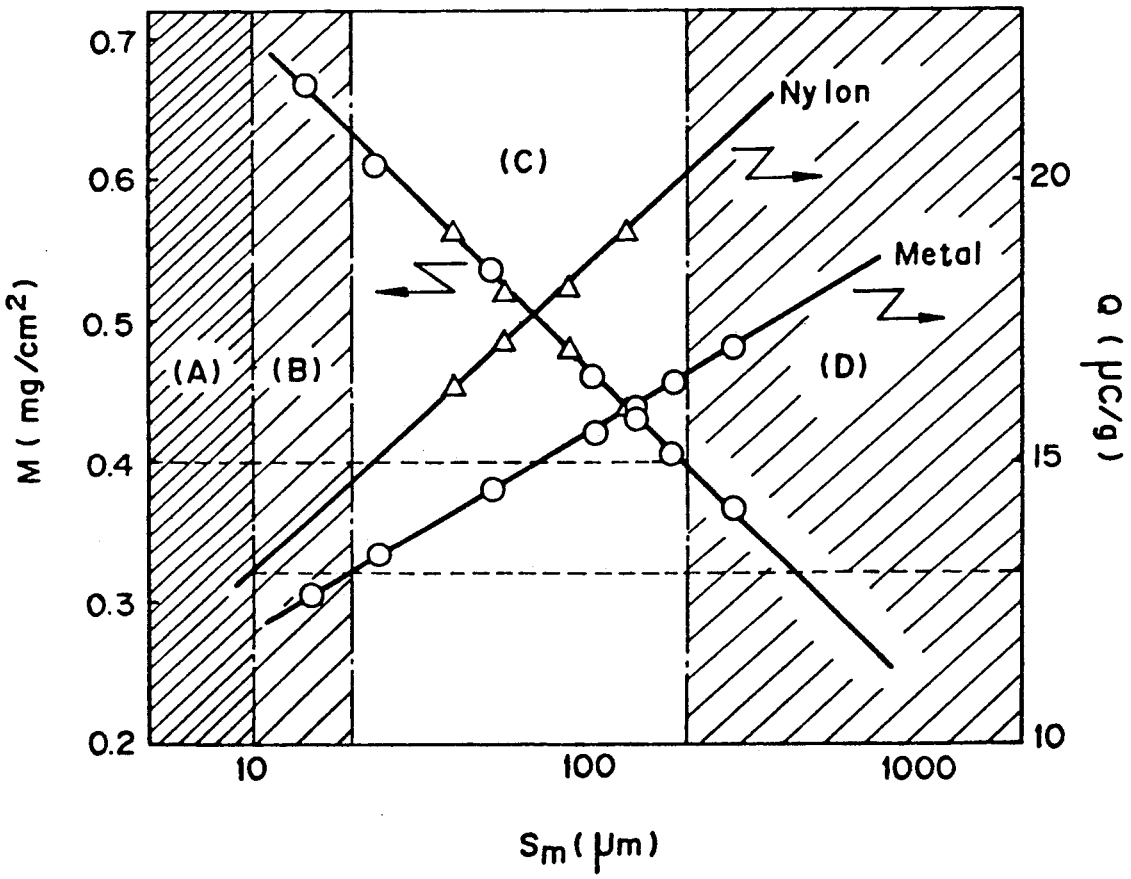
FIG. 3 shows the relationship of toner coverage and charge amount to mean mountain distance.

The relationship of toner coverage and charge amount to mean mountain distance (Sm) as obtained in Test Examples 1-12 were shown in FIG. 3.

It is understood that the toner coverage amount M increases and the toner charge amount Q decreases as mean mountain distance Sm becomes smaller, and that the toner coverage amount M decreases and the toner charge amount Q increases as Sm becomes bigger.

In FIG. 3, the region (A) of less than 10 μm in Sn: means that the decrease of charge amount causes the deterioration of image quality such as fogs on a paper sheet, toner flying around characters and the like though sufficient amount of toners is obtained.

The region (D) of more than 200 μm in Sm that the lack of toner coverage amount caused the deterioration of image qualities such as image density and the like although fogs on a sheet and toner flying around the characters, hardly occur.

Therefore, it is understand that mean mountain distance is 20–200 μm, preferably 40–160 μm in order to achieve the objects of the invention.

What is claimed is:

1. A developing device disposed adjacently to an electrostatic latent image support member, comprising:

a rotatably arranged toner transport member contacting the electrostatic latent image support member for developing an electrostatic latent image with the use of a non-magnetic toner and a member contacting the toner transport member for forming a toner layer on an external surface of the toner transport member and for charging the non-magnetic toner, said toner transport member having irregularly surface spaced irregularities of 20–200 μm in mean mountain distance.

2. A developing device of claim 1, wherein the irregularities are 5 μm in ten points mean roughness.

3. A developing device of claim 2, wherein the toner transport member is a filmy member comprising resin.

4. A developing device of claim 1, wherein the toner transport member comprises electroformed nickel.

5. A developing device of claim 4, wherein the transport member comprises a fine particle containing deposition layer on the surface of electroformed nickel.

6. A developing device of claim 1, wherein the irregularities is 40–160 μm in mean mountain distance.

7. A developing device of claim 1, wherein the surface of the toner transport member has ten points mean-roughness of 5 μm or less.

8. A developing device of claim 1, wherein the surface irregularities have a non-uniform shape.

9. A developing device disposed adjacently to a rotatably arranged electrostatic latent image support member which comprises;

a rotatably arranged toner transport member comprising:

a rotatably arranged roller confronting the electrostatic latent image support member;

a cylindrically formed flexible filmy member having a peripheral length slightly longer than that of the roller so as to be mounted loosely around the roller;

a first means for biasing the filmy member against the roller to form a slack of said filmy member at a location confronting the electrostatic latent image support member; and a second means for forming a toner layer on external the surface of the filmy member;

said cylindrically formed, flexible filmy member having irregularly spaced surface irregularities of 20–200 μm in mean mountain distance.

10. A developing device of claim 7, wherein the irregularities are 5 μm in ten points mean roughness.

11. A developing device of claim 10, wherein the filmy member comprises resin.

12. A developing device of claim 9, wherein the filmy member comprises electroformed nickel.

13. A developing device of claim 12, wherein the filmy member comprises a fine particles contained in a deposition layer on the surface of electroformed nickel.

14. A developing device of claim 9, wherein the irregularities is 40–160 μm in mean mountain distance.

15. A developing device of claim 9, wherein the first means has an internal peripheral surface in accordance with an external peripheral surface of the developing roller to bias the filmy member against the roller at the both ends of the roller.

16. A developing device of claim 9, wherein the surface irregularities have a non-uniform shape.

17. A developing device disposed adjacently to an electorstatic, latent image support member comprising:

a rotatably arranged roller confronting the electrostatic latent image support member;

a cylindrically formed flexible filmy member having a peripheral length slightly longer than that of the roller so as to be mounted loosely around the roller, said filmy member having irregularly spaced surface irregularities of 20–200 μm in mean mountain distance;

means for biasing the filmy member against the roller to form a slack of said filmy member at a location confronting the electrostatic latent image support member; and a member contacting the toner transport member for forming a non-magnetic toner layer on external surface of the filmy member and for charging the non-magnetic toner.

18. A developing device of claim 17, wherein the surface of the filmy member has ten points mean-roughness of 5 μm or less.

19. A developing device of claim 17, wherein the surface irregularities have a non-uniform shape.

20. A developing device disposed adjacently to an electrostatic latent image support member comprising:

a rotatably arranged roller confronting the electrostatic latent image support member;

a cylindrically formed flexible filmy member having a peripheral length slightly longer than that of the roller so as to be mounted loosely around the roller, said filmy member having irregularly spaced surface irregularities of 20–200 μm in mean mountain distance;

means for biasing the filmy member against the roller to form a slack of said filmy member at a location confronting the electrostatic latent image support member; and a member contacting the toner transport member for forming a non-magnetic toner layer on an external surface of the filmy member and for charging the non-magnetic toner, said member being pressed against the filmy member at 5 g/mm or less.

21. A developing device of claim 20, wherein the surface irregularities have a non-uniform shape.

* * * * *